United States Patent [19]

Weber et al.

[11] 4,077,320

[45] Mar. 7, 1978

[54] SUSPENSION DEVICE FOR SQUEEGEE-SUPPORTING TUBES IN ROTARY SCREEN PRINTER

[75] Inventors: Roger Weber, Pfastatt; André Lotte, Mulhouse, both of France

[73] Assignee: Societe Alsacienne de Constructions Mecaniques de Mulhouse, Mulhouse Cedex, France

[21] Appl. No.: 708,007

[22] Filed: Jul. 23, 1976

[30] Foreign Application Priority Data

Aug. 12, 1975 France ..... 7525047

[51] Int. Cl.[2] ..... B41F 15/44

[52] U.S. Cl. ..... 101/119; 101/120

[58] Field of Search ..... 101/115, 116, 127.1, 101/128.1, 119, 120

[56] References Cited

U.S. PATENT DOCUMENTS

| | | | |
|---|---|---|---|
| 3,718,086 | 2/1973 | Vertegaal | 101/115 |
| 3,886,861 | 6/1975 | Anselrode | 101/119 |
| 3,892,176 | 7/1975 | Van der Winden | 101/127.1 |
| 3,960,076 | 6/1976 | Wick | 101/120 |

FOREIGN PATENT DOCUMENTS

| | | | |
|---|---|---|---|
| 2,450,231 | 4/1975 | Germany | 101/120 |
| 2,054,570 | 5/1971 | Germany | 101/116 |
| 2,218,818 | 11/1972 | Germany | 101/120 |
| 546,145 | 2/1974 | Switzerland | 101/128.1 |

*Primary Examiner*—Ronald E. Suter
*Attorney, Agent, or Firm*—Holman & Stern

[57] ABSTRACT

A printing machine with rotary screens particularly adapted for printing fabrics in which a squeegee-mounting tube extends through each screen supported by a pivotable arm which turns about a vertical axis making it possible to move the arm completely away from the entrance to the screen to facilitate squeegee placement and removal; the height of the arm being adjustable by a composite jack on the axis of rotation of the arm for expediting screen changing or cleaning operations.

6 Claims, 4 Drawing Figures

SUSPENSION DEVICE FOR SQUEEGEE-SUPPORTING TUBES IN ROTARY SCREEN PRINTER

FIELD OF THE INVENTION

The present invention relates to a suspension device for the squeegee-supporting tube in a printing machine with rotary screens intended for printing articles in strip form, such as cloths.

BACKGROUND OF THE INVENTION

It is known that in these machines the height of the squeegee-supporting tube must be capable of being regulated in order to adjust the pressure exercised by the squeegee-supporting tube serves as conduit for admission of colour to the interior of the screen. This tube must, moreover, be capable of being easily dismounted and taken out from the screen on each occasion when the screen has to be changed or when the colour-admission tube has to be cleaned.

Up to now, the suspension devices have been fixedly mounted on the side of the bedplate of the machine or of the printing heads, above or below the axis of the screen, and the means for fastening the squeegee tube have been supported by a screw-jack or a fluid jack enabling height adjustment of the squeegee. However, for the squeegee-positioning or squeegee-withdrawing operations, even when putting the suspension device into its extreme position, lowered or raised, the casing of the printing head remained partially covered by the end of the suspension device, and this obstructed the removal or insertion of the squeegee.

SUMMARY AND OBJECTS OF THE INVENTION

The object of the present invention is to bring about a suspension device which enables adjustments in height of the squeegee but without presenting the disadvantages of the known devices, it being possible to move the device according to the invention, aside in order to completely free the entrance to the screen when the squeegee-supporting tube is to be put in place, or taken out.

The subject of the present invention is a suspension device for the squeegee-supporting tube, which comprises an arm provided near its end with means for releasably fastening said tube, said arm being mounted for pivotal movement about a substantially vertical shaft supported by the bedplate of the machine in such manner as to enable pivotal movement of same, and to free completely the entrance to the screen, when the squeegee-supporting tube is released from said fastening means. The height-adjustment means act directly on the arm to cause same to be raised or lowered on said shaft.

In accordance with a preferred embodiment of the invention, the height-adjustment means comprises a screw-jack and a fluid jack, the shaft common to these jacks serving as the shaft on which is pivoted the squeegee-supporting arm. The screw-jack may serve to adjust manually and stabilize the height of the squeegee, while the fluid jack may serve to raise the squeegee automatically in order to disengage same from the screen.

Further objects and advantages of the invention will become apparent upon consideration of the following description of an exemplary embodiment when taken in conjunction with the drawings, forming a part of the description, in which one embodiment of the invention is described, by way of example only.

DESCRIPTION OF A PREFERRED EMBODIMENT

Figure 1:
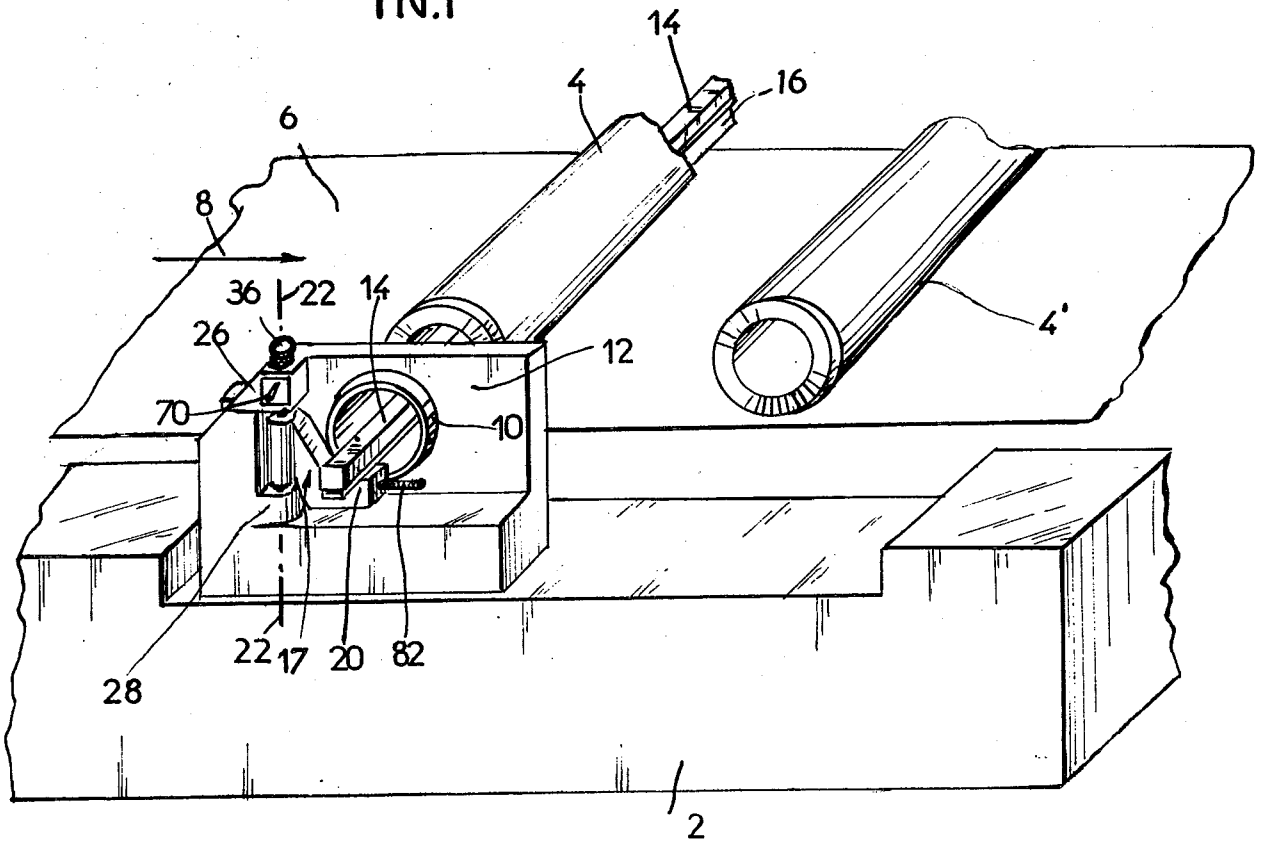
FIG. 1 is a perspective diagrammatic view of part of a printing machine fitted with a device according to the invention.

In the diagrammatic view of FIG. 1. there are shown only the essential parts of a rotary printing machine which comprises a bedplate 2, cylindrical screens 4, 4', etc., rotatably driven by standard means (not shown), and a belt 6 which is driven in the direction of the arrow 8 and which supports the strip material, such as cloth, to be printed.

Each screen is mounted, at each side of the machine in a casing 10 which is journalled in a bearer, or printing head 12, itself mounted on the bedplate of the machine.

At the interior of each screen, a squeegee holder, generally constituted by a tube 14, of square or round section, supports the squeegee 16 which, during operation of the machine, obviously bears against the lower generatrix of the pertaining screen in order to distribute the colour there. Generally the colour is introduced into the interior of the screen through the tube 14, by supply tubes not shown in FIG. 1.

Figures 2, 4:
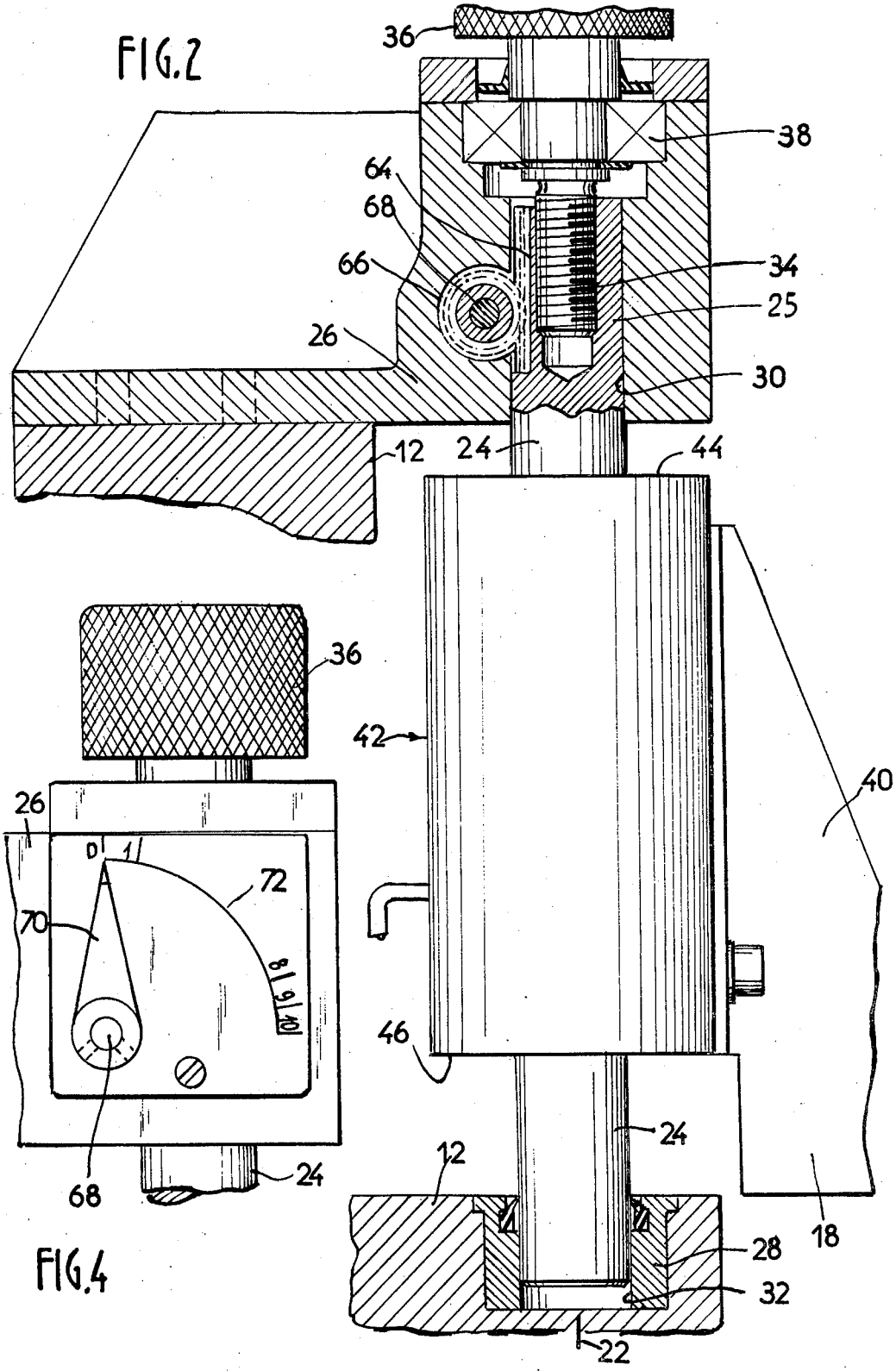
FIG. 2 is an enlarged elevational view, partly in section, of the means for suspending the squeegee.
FIG. 4 is enlarged elevational view of the upper part of the device.
Figure 3:
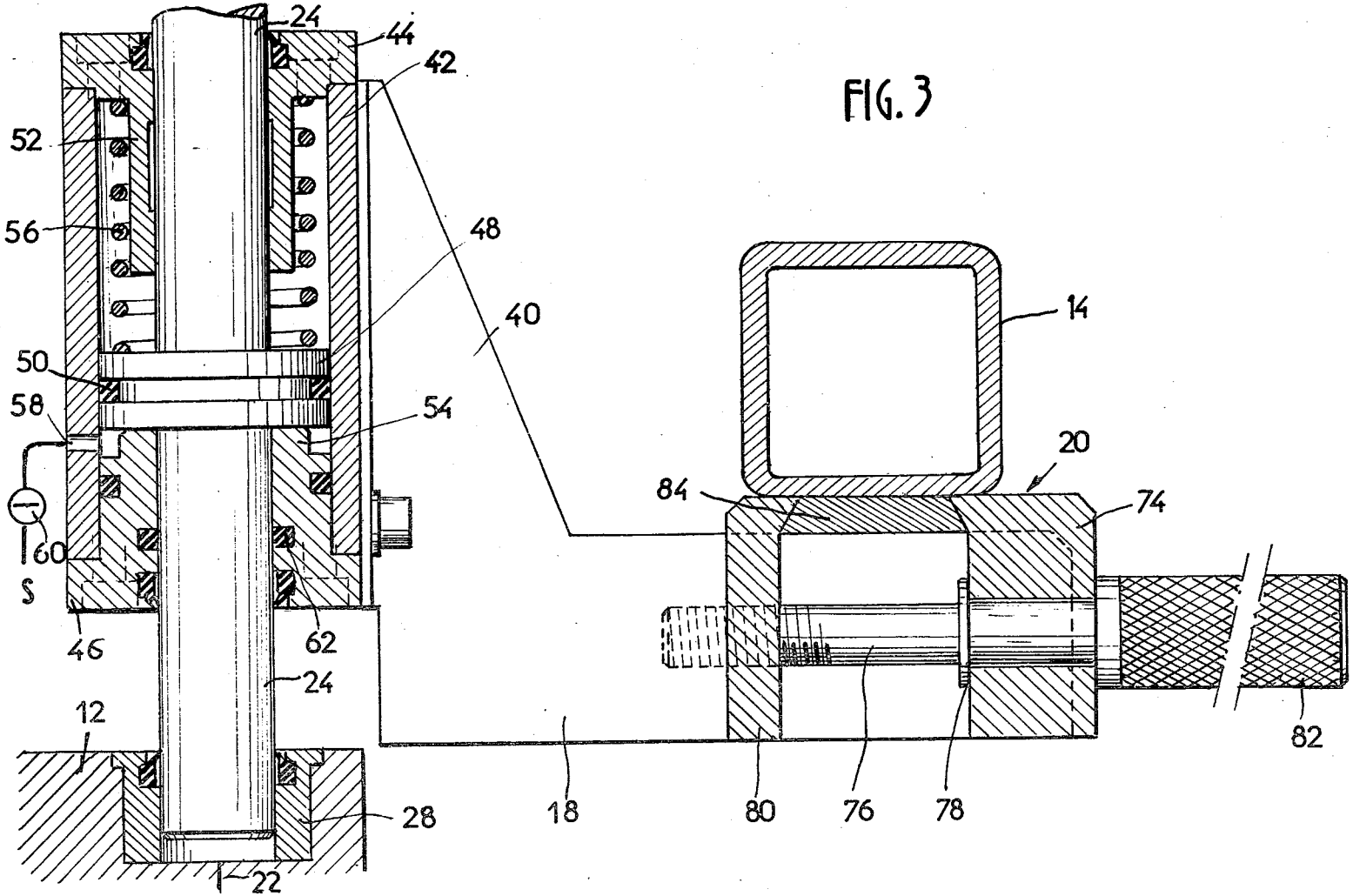
FIG. 3 is an enlarged sectional view of the pivoting arm and of the jack for raising the squeegee.

The tube 14 is supported, at each of its ends, by suspension means denoted generally by the reference numeral 17 in FIG. 1 and which is shown in greater detail in FIGS. 2 and 3.

According to the present invention, the suspension means comprises mainly a pivoting arm 18 which has a horizontal upper face provided, close to its distal end, with holder means 20 for releasably fastening the tube 14.

The arm 18 is mounted for pivotal movement about a vertical or substantially vertical axis 22 which is that of a shaft 24 mounted in two pillow-blocks 26, 28 integral with the printing head 12. The arm 18 is supported by, and can pivot about, the shaft 24 so that, when it is desired to pull the sqeegee out, it suffices to release the holder means 20 then to make the arm pivot towards the exterior of the machine.

The entrance into the casing 10 of the printing head is thus completely free and no obstacle hinders the operation of removing (or setting up) the tube 14 with its squeegee.

Adjustment of the height of the squeegee is brought about by causing the arm 18 to go up or down on the shaft 24, between the pillow-blocks 26–28, this shaft 24 forming in combination, the pivotal axis of the arm as well as the height adjustment means.

The shaft can slide axially in bores 30 and 32 respectively provided in the pillow-blocks 26, 28 but it is prevented from turning in these bores by means which will hereinafter be described.

An axial bore in the upper end 25 of the shaft 24 is tapped or screw-threaded and holds the threaded end 34 of a screw with a knurled knob 36 which is mounted pivoting in the pillow-block 26, for example, by means of a bearing 38, but without being able to move upwards or downwards with respect to the pillow-block. The screw 34 and screw-threaded bore of shaft 24, form together, an axial screw-and-nut connection interposed between said shaft and pillow-blocks 26 or printing head 12.

That end of the arm 18 which is nearer the shaft 24 forms a bracket 40 which is secured to a cylinder 42. The shaft 24 slides through the two upper and lower cylinder heads 44 and 46, the cylinder, being therefore able to revolve around the shaft 24, the result of which is that the arm 18, integral with the cylinder 42, can therefore pivot about the shaft 24 as has hereinbefore been pointed out.

The shaft 24 forms a piston rod which supports, in the portion thereof located within the cylinder 42, a piston 48 provided with a fluid-tight packing-ring 50 (FIG. 3). The two cylinder heads 44 and 46 hold bushes 52, 54, respectively, the ends of which serve as end-of-stroke stops for the piston 48. A helical spring 56, interposed between the upper cylinder 44 and the head piston 48, tends to cause the cylinder 42 to ascend relative to the shaft 24, if the latter is considered stationary, that is to say tends to cause the arm 18 to ascend in order to move the squeegee away from the screen.

There opens into the lower chamber of the cylinder 42, i.e. at a level lower than the lowermost level of the piston in the cylinder, an inlet 58 for fluid under pressure, for example compressed air coming from a source S through the intermediary of a valve 60. On the other hand, a gasket 62 provided in the head 46 ensures the fluid-tightness of the passage of the shaft 24 through the lower cylinder head 46.

The whole of the means for adjusting the height of the arm 18 constitutes a combination of a screw-jack with a single action pneumatic jack, the common axis of these jacks forming the pivot axis of the arm 18. In the embodiment shown, the piston of the pneumatic jack is stationary (while being positionally adjustable) and it is the cylinder which is moving when the fluid under pressure is admitted into or purged from the jack cylinder.

Before describing the operation of the device, it may be stated that means is preferably provided for keeping a close watch on the position of the arm 18 fixed by the manually-controlled knob 36.

This means may comprise, cut on the upper end 25 of the shaft 24, a rack 64 which engages with a pinion 66 the axle 68 of which is journalled in the pillow-block 26. On the end of the axle 68 which passes beyond the pillow-block 26 is fixed a pointer 70 (FIG. 4) which is displaced in front of graduations 72. The position of the pointer 70 thus represents in a manner visible to the operator the height position of the shaft 24.

At the same time, the rack 64 and its pinion 66 constitute the means for rendering the shaft 24 rotatively immovable with respect to the pillow-blocks 26 and 28, which has been brought up hereinbefore.

OPERATION

The manner of working of the height-adjustment device is as follows: With squeegee-holding tube 14 being in place in the screen and having been fixed at the end of the arm 18 by the means 20 for putting the tube 14 in place, compressed air is admitted into the jack 42 and as a result the cylinder 42 moves downwards (with respect to the stationary shaft 24) until the end of the upper bush 52 comes to rest against the piston 48.

Then, by means of the knurled knob 36, the pressure of the squeegee on the screen is manually adjusted, the rotation of the knob 36 resulting in rise or descent of the shaft 24, the piston 48, the abutment bush 52 which is resting on the piston, the cylinder 42, the arm 18 which is fast with the cylinder and lastly the squeegee-holding tube.

It will be seen therefore that the position of the squeegee is directly readable (and reproducible) on the graduations 72.

If the printing operation has to be interrupted, it suffices to open to atmosphere the compressed air valve 60 in order to purge the cylinder. The spring 56 then causes the cylinder to rise with respect to the stationary piston (until it occupies the position shown in FIG. 3), over a predetermined distance (for example of the order of 15 mm) which is determined by the distance apart of the two abutment bushes 52, 54. In order to restart the machine, it suffices to supply the jack with compressed air again in order that the squeegee takes up exactly its former position or any other selected position which is determined by the indication of the pointer 70.

It will therefore be seen that the pneumatic jack allows the automatic raising of the squeegee while the screw-jack allows adjustment of the pressure with which the squeegee is applied on the screen.

The means 20 for fastening the squeegee-holding tube 14 on the end of the arm 18 may be of any type whatsoever, but use is preferably made of a quick-operating means which is shown in FIG. 3.

This means comprises, at the end of the end of the arm 18 a fixed jaw 74 in which can turn a threaded rod 76 prevented from sliding by a ring 78. Within the arm there can slide a movable jaw 80 into which the rod 76 is screwed. A handle 82 enables manual tightening or slackening of the clamp made up by the two jaws 74, 80.

The squeegee-supporting tube is provided with a shoulder 84, for example in the form of a dovetail, on to which the two jaws are tightened.

It will be seen that, in order to remove the squeegee, it suffices to unscrew the handle 82, then, by means of this same handle 82, to cause the arm 18 to pivot about the shaft 24 in order to clear the front part of the printing head completely and thus to be able to take the squeegee out of the screen easily.

The invention therefore enables easier manipulations of the squeegee than in the past while making possible precise and quick adjustments in the height of the squeegee.

Naturally, the invention is not restricted to the embodiment described and shown, and is capable of many variations, within the province of the expert, in accordance with the applications contemplated and without thereby departing from the scope of the invention.

We claim:

1. A suspension device for a squeegee-supporting tube in a horizontal, cylindrical rotary screen of a printing machine having a printing head, said rotary screen having a rotational axis, said suspension device comprising:

a substantially horizontal arm having a vertically unobstructed horizontal upper face, said arm being mounted for pivotal movement on a vertical axis laterally offset with respect to the rotational axis of said cylindrical rotary-screen, by a distance sufficient to permit clear lateral access to the end of said cylindrical screen;

releasable-securing means on the distal end of said arm upper face, releasably securing one end of said squeegee-supporting tube on said horizontal upper face of said arm for permitting said tube end to be readily disengaged from said arm;

support means on said printing head positively supporting said pivoting arm for free pivotal movement; and adjusting means adjustably positioning said support means along said vertical axis with respect to said printing head, whereby release of said releasable-securing means from said squeegee-supporting tube permits said arm to be pivoted on said vertical axis away from the end of said cylindrical screen so that ready access is attained to the squeegee so that the squeegee can be readily removed and/or replaced by withdrawal and insertion at the end of the exposed cylindrical screen.

2. The device of claim 1 with a dove-tail element secured to said end of said squeegee-supporting tube, said releasable securing means comprising a fixed jaw mating with said dove-tail element and secured to said upper face of said arm, a movable jaw also mating said said dove-tail element and slidably mounted on said upper face of said arm for movement toward and away from said fixed jaw to clamp and release said dove-tail element respectively, and manually operable screw means engaged in said fixed and movable jaws for moving said movable jaw toward and away from said fixed jaw.

3. The device of claim 1, wherein said support means comprises a piston-and-cylinder device with a piston rod secured to said piston and coaxially arranged on said vertical axis, said arm being secured to said cylinder while said piston rod is carried by said printing head.

4. The device of claim 3, wherein said piston-and-cylinder device has a single action, said cylinder having lower and upper cylinder heads, a pressure fluid inlet and outlet port through said cylinder adjacent said lower cylinder head for urging said cylinder and squeegee-supporting tube downwardly, and return spring means interposed between said piston and said upper cylinder head for normally urging said cylinder upwardly.

5. The device of claim 3, wherein said piston rod is mounted for vertical sliding movement in said printing head, means preventing said piston rod from pivoting movement relative to said printing head, and an axial screw-and-nut connection coaxial with said vertical axis interposed between said piston rod and said printing head, said adjusting means comprising a manually-operable adjustment member operatively connected to a screw of said screw-and-nut connection.

6. The device of claim 5, further comprising:

a toothed rack in said piston rod, a toothed pinion engaged with said toothed rack, an axle freely rotatably mounted in said printing head and carrying said toothed pinion, and indicating means carried by said axle for indicating the position of said piston rod.

* * * * *